US007891070B2

(12) United States Patent
Buckley

(10) Patent No.: US 7,891,070 B2
(45) Date of Patent: Feb. 22, 2011

(54) METHOD FOR HANDLING ELONGATE STRENGTH MEMBERS

(75) Inventor: David L. Buckley, Monrovia, CA (US)

(73) Assignee: Air Logistics Corporation, Monrovia, CA (US)

( * ) Notice: Subject to any disclaimer, the term of this patent is extended or adjusted under 35 U.S.C. 154(b) by 983 days.

(21) Appl. No.: 11/735,436

(22) Filed: Apr. 14, 2007

(65) Prior Publication Data

US 2008/0250631 A1 Oct. 16, 2008

(51) Int. Cl.
*B23P 11/00* (2006.01)

(52) U.S. Cl. ..... 29/446; 29/452; 29/820

(58) Field of Classification Search ..... 29/446, 29/452, 419.1, 820; 57/314
See application file for complete search history.

(56) References Cited

U.S. PATENT DOCUMENTS 3,017,450 A 1/1962 Crosby et al.
3,500,625 A 3/1970 Gokyu
3,526,570 A 9/1970 Durkee et al.
3,586,226 A 6/1971 Nippert
3,659,633 A 5/1972 Durkee et al.
3,829,956 A 8/1974 Miner
3,855,777 A 12/1974 Durkee et al.
3,919,762 A 11/1975 Borelly
3,951,355 A 4/1976 Morioka et al.
4,117,582 A 10/1978 Borelly
6,560,807 B1 5/2003 Stubler et al.
6,658,684 B2 12/2003 Stubler et al.
6,800,164 B2 * 10/2004 Brandstrom ..... 156/166

* cited by examiner

*Primary Examiner*—Jermie E Cozart
(74) *Attorney, Agent, or Firm*—Christie, Parker & Hale, LLP

(57) ABSTRACT

A method and device for handling an elongate strength member. In the method, an elongate strength member with a plurality of elongate composite rods, or metal wires or plastic fibers are bundled together with the composite rods, or metal wires, or plastic fibers in a generally parallel and untwisted and un-spiraled arrangement when the elongate strength member is extended along a generally straight path, wherein the composite rods are longitudinally and rotatably moveable relative to each other. It is then twisted relative to a longitudinal dimension of the elongate strength member and the path of the elongate strength member is curved, such as by coiling.

25 Claims, 6 Drawing Sheets

METHOD FOR HANDLING ELONGATE STRENGTH MEMBERS

BACKGROUND

This invention relates to the field of strength members and how to handle them, and more particularly to a device, method and coiled form of a strength member wherein the individual composite rods, or metal wires, or plastic fibers, or other materials in the strength member are bundled together in a generally parallel, untwisted and unspiraled orientation when the strength member follows along a generally straight path, but when the strength member is coiled, e.g., on a spool device, the strength member will be twisted along it longitudinal axis and the individual composite rods, or metal wires or plastic fibers forming the strength member will be in a twisted and spiraled orientation so that no undue stresses will be exerted on the coiled strength member. This twisting and spiraling will be more pronounced for rods, or wires, or fibers lying closer to the outer perimeter of the strength member and rods, or metal wires, or plastic fibers lying closer to a centerline of the strength member will be less twisted and spiraled or possible not twisted or spiraled. The invention is particularly well suited for strength members formed of composite rods, such as carbon fiber rods and composite rods formed of other materials such as glass fiber, synthetic fibers and the like, but can be used in forming long strength members of other materials, such as metal wire, plastics fibers, etc.

In the case of metal wires that wound on spools, these wires have a cast, or natural tendency to curve or twist along a clockwise or counterclockwise path, depending on whether the wire was wound clockwise or counterclockwise. Thus, when forming cable from these wires, manufacturers have either first straightened the wires before forming the cables, or have handled the natural cast, such as by balancing the casts of wires by arranging wires with opposite casts during the forming of the cable. Failure to deal with the natural case may result in cables that have a tendency to twist or coil in one direction or the other. Whether the metals wires are first straightened before being formed into cables, or are arranged with opposite casts, this does involves extra steps or extra attention being required during the manufacturing process. In contrast, in the case of composite rods, e.g., formed or carbon fibers and resins, these rods do not have a natural cast and thus they can be used to form cables without any straightening or consideration of whether the composite rods come prepared wound on spools in a clockwise or counterclockwise orientation.

For cables formed of metal wires in a generally parallel orientation, others, such as Durkee et al. (U.S. Pat. Nos. 3,526,570 and 3,659,633) have attempted to balance internal forces by bundling wires together that have opposite casts. Durkee et al. further disclose that by binding the bunched up wires by resilient securing material (i.e., flexible tape) at intervals of every few feet, the wires are allowed to bow out during the winding on a reel, which is said to relieve stress on the wires forming the cables. The individual wires making up the Durkee et al. cables would not be longitudinally or rotabably moveable relative to each other. Furthermore, the Durkee et al. methodology would not be applicable to cables in which the individual wires and strands are not allowed to bow out, such as cables constructed with inflexible binding and/or overwrapping material.

Long lengths of high strength cables are needed for a variety of applications, including lifting cables, long towing cables, mooring cables for offshore drilling platforms that can be located in waters that are many thousands of feet deep, and bridge tendons, to name just a few applications. In the past, these cables were made from materials such as steel, but more recently plastics and composite materials have been used. Composite materials have some advantage in high strength cable applications compared to metal and plastic, including an excellent strength to weight ratio and good corrosion resistance. For example, U.S. Pat. No. 7,137,617 for "Composite Tensioning Members and Method for Manufacturing Same" describes composite tension members made up of a plurality of composite fiber rods that are bundled together with the composite rods parallel to each other and unspiraled, unbraided and without stranding. More typically, composite cables have their composite rods arranged similarly to the wires and filaments in wire cables and ropes, namely, either they are formed by providing different layers of rods that are wound counter-helically relative to each other, as shown in prior art FIG. 1, which shall be referred to herein as stranded composite cables, or in a so-called six around one design, shown in prior art FIG. 2. One reason this is done is because the stranded composite cables in either prior art embodiment can be more readily bent and thereby wound around a spool for storage and handling. In contrast, composite cables with parallel composite rods, such as those disclosed in U.S. Pat. No. 7,137,617, are more difficult to handle and wind on a spool and the like. The machinery used to form very long lengths of larger diameter cables can be quite large and expensive due to the necessity of twisting together a number of very long rods, which rods themselves are spooled out from large spools, which number of large spools are themselves on a rotating carriage.

While stranded cables, whether formed of metal wire, plastics rods or fibers, or composite rods, can be more easily handled, there are some disadvantages with stranded cables. Stranded cables are made up of different overlapping layers of counter-helically wound rods, metal wires or plastic fibers, (as shown in FIGS. 1 and 2A.) In the cable with a six around one design of FIG. 2, there are many crossover points where crossing rods, metal wires, or plastic fibers contact each other. In the case of applications where such cables may sway, swing, or otherwise move, for example, as in mooring cables where they can be moved by ocean currents and the like, the effects of internal rubbing and abrasion of the composite rods, metal wires or plastic fibers in the crossover areas, for example, can weaken the cable. Moreover, in particular case of stranded composite cables, that are made of composite rods which are generally less stretchable than other materials, because of different rod lengths, some rods may carry more tension than other rods and this can result in less than optimal cable strength or failure of the cable. In contrast, cables where the individual composite rods, metal wires or plastic fibers are parallel to each other do not experience the problem of rubbing, and can be made so that each rod, metal wire or plastic fiber more evenly carries an equal tensile load, which helps in maximizing the strength of the cable. Moreover, due to tighter packing of the individual rods, or metal wires or plastic fibers in cables with a parallel rod, metal wire or plastic fiber configuration compared to counter-helically assembled or braided or six around one, for example, cables, the cable diameter of cables with a parallel composite rod, or metal wire, or plastic fiber configuration with the same number and size of composite rods, or metal wires, or plastic fibers can be made smaller in diameter. Thus, for a given size and weight and same material, a parallel composite rod, or metal wire, or plastic fiber cable will be lighter and have a smaller diameter, which means that a greater length of cable can be carried in the same space. As noted above, composite cables formed of parallel composite rods deliver excellent performance in terms of strength, weight, and space and is most ideal, although cables made of other materials are possible.

Accordingly, it would be beneficial to have a method and device for handling cables with parallel composite rods, or metal wires, or plastic fibers and also cables with parallel composite rods, metal wires, or plastic fibers provided on spools.

SUMMARY

The invention provides a device, method and a coiled form of a strength member wherein the individual composite rods, or metal wires, or plastic fibers in the strength member are bundled together in a generally parallel, untwisted and unspiraled orientation when the strength member follows along a generally straight path, but when the strength member is coiled, e.g., on a spool device, the strength member will be twisted along it longitudinal axis and the individual composite rods, or metal wires, or plastic fibers forming the strength member will be in a twisted and spiraled orientation so that no undue stresses will be exerted on the coiled strength member. As noted above, this twisting and spiraling will be more pronounced for composite rods, or metal wires or plastic fibers lying closer to the outer perimeter of the strength member and composite rods, or metal wires or plastic fibers lying closer to the centerline of the strength member will be less twisted and spiraled or possible not twisted or spiraled.

The invention provides a method for handling an elongate strength member, which comprises taking an elongate strength member composed of a plurality of elongate composite rods, or metal wires, or plastic fibers that are bundled together with the composite rods, or metal wires, or plastic fibers in a generally parallel and untwisted and unspiraled arrangement when the elongate strength member is extended along a generally straight path, twisting the elongate strength member relative to a longitudinal dimension of the elongate strength member, and curving the path of the elongate strength member.

The invention further provides a method for coiling an elongate strength member that comprises a plurality of elongate composite rods, or metal wires, or plastic fibers that are bundled together with the composite rods, or metal wires, or plastic fibers in a generally parallel and untwisted and unspiraled arrangement when the elongate strength member is extended along a generally straight path, the method comprising twisting the elongate strength member so that its composite rods, or metal wires, or plastic fibers are twisted and spiraled, and bending the twisted elongate strength member into a coil.

The invention yet further provides a device for handling an elongate strength member that has a plurality of elongate composite rods, or metal wires, or plastic fibers that are arranged with the composite rods, or metal wires, or plastic fibers in a generally parallel and untwisted and unspiraled arrangement when the elongate strength member is extended along a generally straight path, the device comprising a payout device that twists the elongate strength member as the elongate strength member is coiled around a spool device with a coil carrying portion.

The invention also provides a spool device with an elongate strength member coiled in coils thereon, comprising a spool device, and elongate strength member with a longitudinal axis, comprising a plurality of elongate composite rods, or metal wires, or plastic fibers that are arranged in a generally parallel and spiraled orientation relative to the elongate strength member's longitudinal axis and coiled on the spool device, wherein in coils of the elongate strength member on the spool device, the elongate composite rods, or metal wires, or plastic fibers in a given arc section of the coiled elongate strength member will have generally the same length.

DETAILED DESCRIPTION OF THE INVENTION

Figure 1:
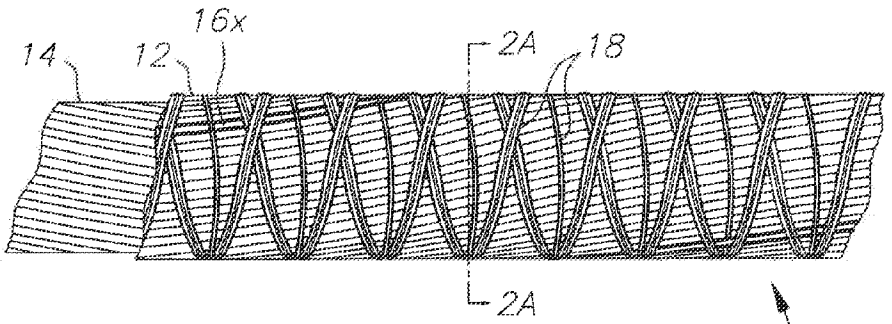
FIG. 1 PRIOR ART
FIG. 1 is a top, partially exposed view of a section of a prior art stranded cable showing the counter-helically wound layers of composite rods, or metal wires, or plastic fibers.

FIG. 1 is a top, partially exposed view of a section of a prior art stranded cable 10 showing two counter-helically wound layers 12 and 14 of composite rods 16*a-n*, wherein n=any number of rods used to make up the cable 10. Also shown are binding threads 18 which are wrapped around the composite rods, or metal wires, or plastic fibers, etc. to hold them together Other than the binding thread, and a cover material, such as a plastic layer (not shown), the composite rods, or metal wires, or plastic fibers are otherwise not held together and the composite rods, or metal wires, or plastic fibers 16*a-n* are capable of moving laterally with respect to each other, such as when the cable 10 is bent or curved, or such as when it is coiled around a spool. One rod, or metal wire, or plastic fiber 16*x* is shown with contrasting shading to show how the composite rods, or metal wires, or plastic fibers are counter-helically spiraled to make up the stranded cable 10.

Figure 2A:
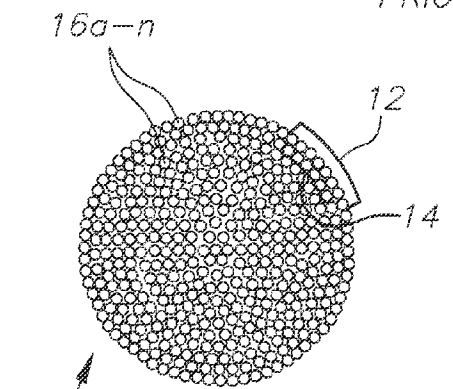
FIG. 2A PRIOR ART
FIG. 2A is a cross-sectional view of the prior art stranded cable of FIG. 1 along view lines 2A-2A.
Figure 2:
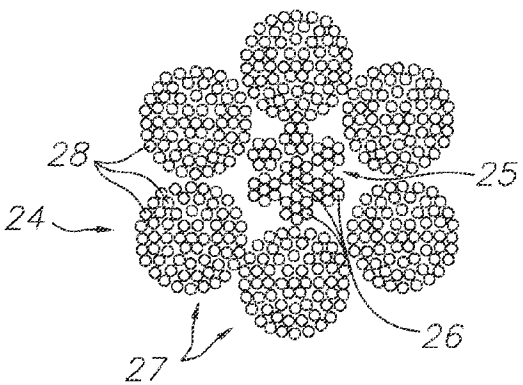
FIG. 2 PRIOR ART
FIG. 2 is a cross-sectional view of a prior art six around one stranded cable.

FIG. 2 is a cross-sectional view of a prior art six around one stranded cable 24. It is made up of a central cable section 25, which in turn is made up of composite rods, or metal wires, or plastic fibers 26, which central cable section 25 is surrounded by a group of six outer cable sections 27, which in turn are formed of composite rods, or wires, or fibers 28. As in conventional flexible wire rope, the individual composite rods, or wires, or fibers 26 in the central cable section 25, and the individual composite rods, or wires, or fibers 28 in the outer cable sections 26 are helically twisted, and the outer cable sections 26 are twisted around the central cable section 25. By way of example and as a reference, for construction of a target mooring line cable with design load of 2 million pounds, the diameter of such a six around one stranded cable made up of appropriate sized carbon fiber composite rods in sufficient numbers would be approximately 3.53 inches in diameter, and have a relative length (equal volume) of 1.0.

FIG. 2A is a cross sectional view of the composite cable 10 along view lines 2A-2A of FIG. 1. A plurality of composite rods 16*a-n*, in counter-helically wound layers, e.g., 12 and 14, make up the cable. By way of comparison with the prior art six around one rope design of FIG. 2 described above, for construction of a target mooring line cable with design load of 2 million pounds, the diameter of such a counter-helically wound cable made up of appropriate sized carbon fiber composite rods in sufficient numbers would be approximately 3.12 inches in diameter, and have a relative length (equal volume) of 1.28 compared to the conventional six around one stranded rope design shown in FIG. 2. Thus, a composite stranded cable manufactured from a plurality of counter-helically composite rods has a greater relative length than a six around one configuration having the same tensile strength.

Figure 3:
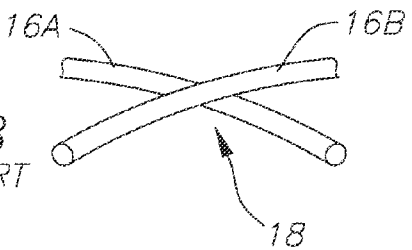
FIG. 3 PRIOR ART
FIG. 3 is a diagrammatic view showing two composite rods, or metal wires, or plastic fibers of the prior art stranded cable that are crossed over.

FIG. 3 is a diagrammatic view showing two composite rods, metal wires, or plastic fibers 16A and 16B of the prior art stranded cable 10 from two adjacent layers 12 and 14 that are crossed over at a crossover point 18. There will be similar crossover points 18 throughout the prior art stranded cable 10 of FIGS. 1 and 2A and the six around one cable 24 of FIG. 2. At the crossover points 18, any movement of the rods, wires or fibers with respect to each can cause the composite rods, wires or fibers to be moved relative to each other internally and can thereby cause wearing and abrasion in the composite rods, metal wires, or plastics fibers at the crossover points 18, which could eventually lead to weakening of the cables 10 and 24.

Figure 4:
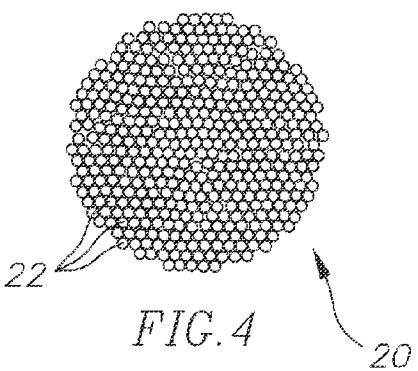
FIG. 4 is a cross-sectional view of an exemplary cable with parallel composite strands, or wires, or plastic fibers that would have the same tensile strength as the prior art cables shown in FIGS. 1 and 2A, and 2.

FIG. 4 is a cross-sectional view of an exemplary composite cable 20 made up of a plurality of generally parallel carbon fiber composite rods 22 that are not twisted or spiraled relative to each other that is designed to have the same tensile strength as the prior art cables 10 and shown in FIGS. 2 and 2A. By way of comparison, such an exemplary composite cable 20 is designed for use as a mooring line cable with a design load of 2 million pounds, and the diameter of such a parallel carbon fiber composite rod cable would be approximately 2.88 inches in diameter, and have a relative length (equal volume) of 1.5 compared to the six around one design of FIG. 2. Accordingly, due to the smaller cable diameter as compared to a counter-helically stranded cable of FIGS. 1 and 2A or a six around one cable of FIG. 2, a greater cable length can be carried on a spool device of the same size. The same ratios hold when comparing cables made of same materials such as metal wire, plastic fibers and other materials. The individual rods 22 are longitudinally and rotatably moveable relative to each other in this cable.

Figure 5:
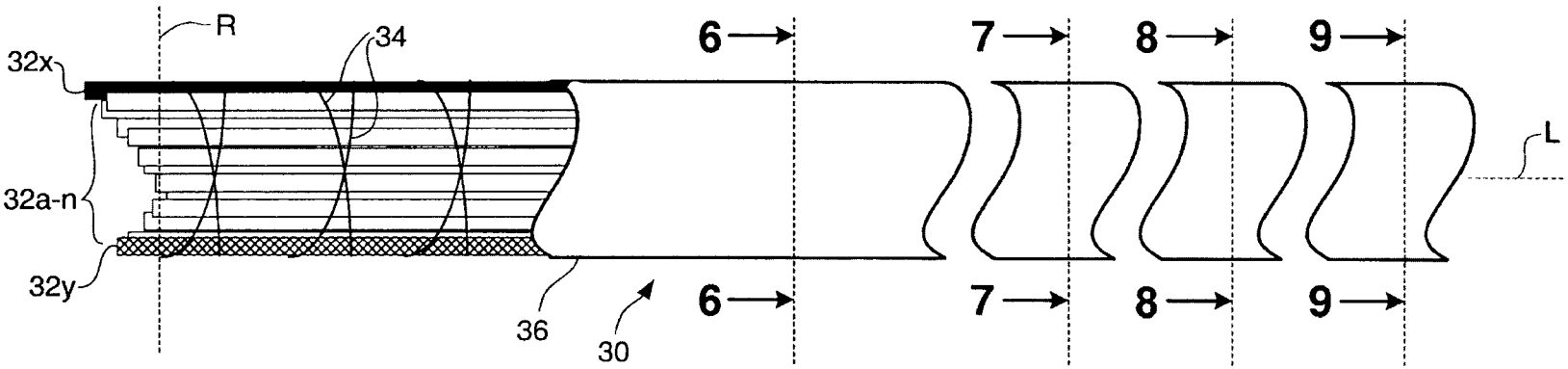
FIG. 5 is a top, partially exposed view of a section of another exemplary cable with generally parallel composite rods, or wires, or plastic fibers.

FIG. 5 is a top, partially exposed view of a composite cable 30 with generally parallel carbon fiber composite rods 32*a-n*, wherein n=any number of rods used to make up the composite cable 30. In order to show a long length, the composite cable is shown with interruptions. The generally parallel composite rods 32*a-n* are preferably held together with a binding material 34, such as threads of synthetic fibers, including Kevlar® brand para-aramid fiber threads. A further protective wrapping 36, such as a plastic sleeve can preferably be used to further protect and enclose the composite rods 32*a-n*. The binding material 34 will prevent the rods from bowing out when the finished cable is being bent, such as when being looped or wound on a drum, but does not prevent the individual rods 32*a-n* from longitudinally and rotatably moving relative to each other in the completed cable. Two composite rods 32*x* and 32*y* are shown with highlighting and shading to show the relative position of these composite rods in the composite cable 30. The dashed line L represents a longitudinal axis L of the composite cable 30 and the dashed line R corresponds to a reference plane R along the composite cable 30 which is perpendicular to the longitudinal axis L. Constructed as such, the binding material 34 and the protective wrapping 36 hold the individual composite rods 32*a-n* together in a bundle but allow the individual composite rods to be moved somewhat relative to each other, e.g., the composite cable 30 can be twisted so that the composite rods can go from a generally parallel configuration shown in FIG. 5 throughout the length of the composite cable 30, to a configuration wherein the composite rods can assume a spiraled path, as will be discussed below. The number, sizes and binding of the individual composite rods 32*a-n* can be varied as desired or required. Indeed, different sized composite rods can be used, and if for any reason rods made of different single materials or combination of materials and/or with different qualities are desired, this can be done. As noted above, while a composite cable is most preferable, the method of the invention can be used in the use of elongate strength members, e.g., a cable, made of metal wires, plastic fibers, plastic rods, or other known materials. Hereinafter, it shall be understood that while a composite cable is described, the method can also be used for handling cable formed of other materials with similar advantages being gained over cables that not formed from parallel wire or fibers.

Figure 6:
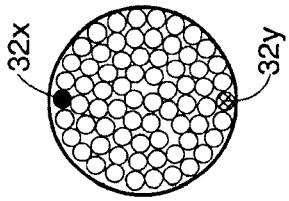
FIG. 6 is a cross-sectional view of the cable of FIG. 5 along view lines 6-6.

FIG. 6 is a cross-sectional view of the composite cable 30 of FIG. 5 taken along view lines 6-6, with the composite cable 30 being untwisted along the longitudinal axis L of the composite cable 30 from the reference plane R to the view lines 6-6. In this view, composite rod 32*x* is at the top of the bundle of composite rods 32*a-n* and composite rod 32*y* is at the bottom of the bundle of composite rods 32*a-n*.

Figure 7:
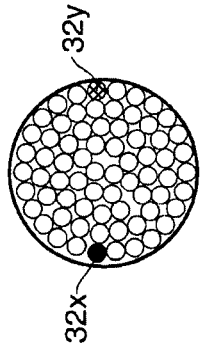
FIG. 7 is a cross-sectional view of the cable of FIG. 5 along view lines 7-7 where the cable has been twisted by 90° counterclockwise relative to the position at view lines 6-6.

FIG. 7 is a cross-sectional view of the composite cable 30 of FIG. 5 along view lines 7-7, but with the composite cable 30 twisted by 90° counterclockwise along the longitudinal axis L of the composite cable 30 from the reference plane R to the view lines 7-7. In this view, the composite rod 32*x* is at the left side of the bundle of composite rods 32*a-n* and the composite rod 32*y* is at the right side of the bundle of composite rods 32*a-n*.

Figure 8:
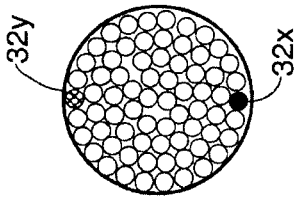
FIG. 8 is a cross-sectional view of the cable of FIG. 5 along view lines 7-7 where the cable has been twisted by 180° counterclockwise relative to the position at view lines 6-6.

FIG. 8 is a cross-sectional view of the composite cable of FIG. 5 along view lines 8-8, but with the composite cable 30 twisted by 180° counterclockwise along the longitudinal axis L of the composite cable 30 from the reference plane R to the view lines 8-8. In this view, the composite rod 32*x* is at the bottom of the bundle of composite rods 32*a-n* and the composite rod 32*y* is at the top of the bundle of composite rods 32*a-n*.

Figure 9:
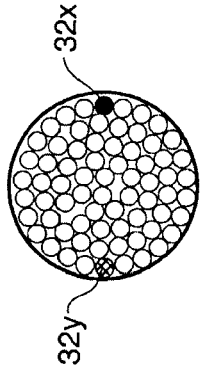
FIG. 9 is a cross-sectional view of the cable of FIG. 5 along view lines 9-9 where the cable has been twisted by 270° counterclockwise relative to the position at view lines 6-6.

FIG. 9 is a cross-sectional view of the composite cable of FIG. 5 along view lines 9-9, but with the composite cable twisted by 270° counterclockwise along the longitudinal axis L of the composite cable 30 from the reference plane R to the view lines 9-9. In this view, the composite rod 32*x* is at the right side of the bundle of composite rods 32*a-n* and composite rod 32*y* is at the left side of the bundle of composite rods 32*a-n*. Not shown is when the composite cable 30 is twisted by 360°, the composite rod 32*x* is at the top of the bundle of composite rods 32*a-n* and the composite rod 32*y* is at the bottom of the bundle of composite rods 32*a-n*.

Figure 10:
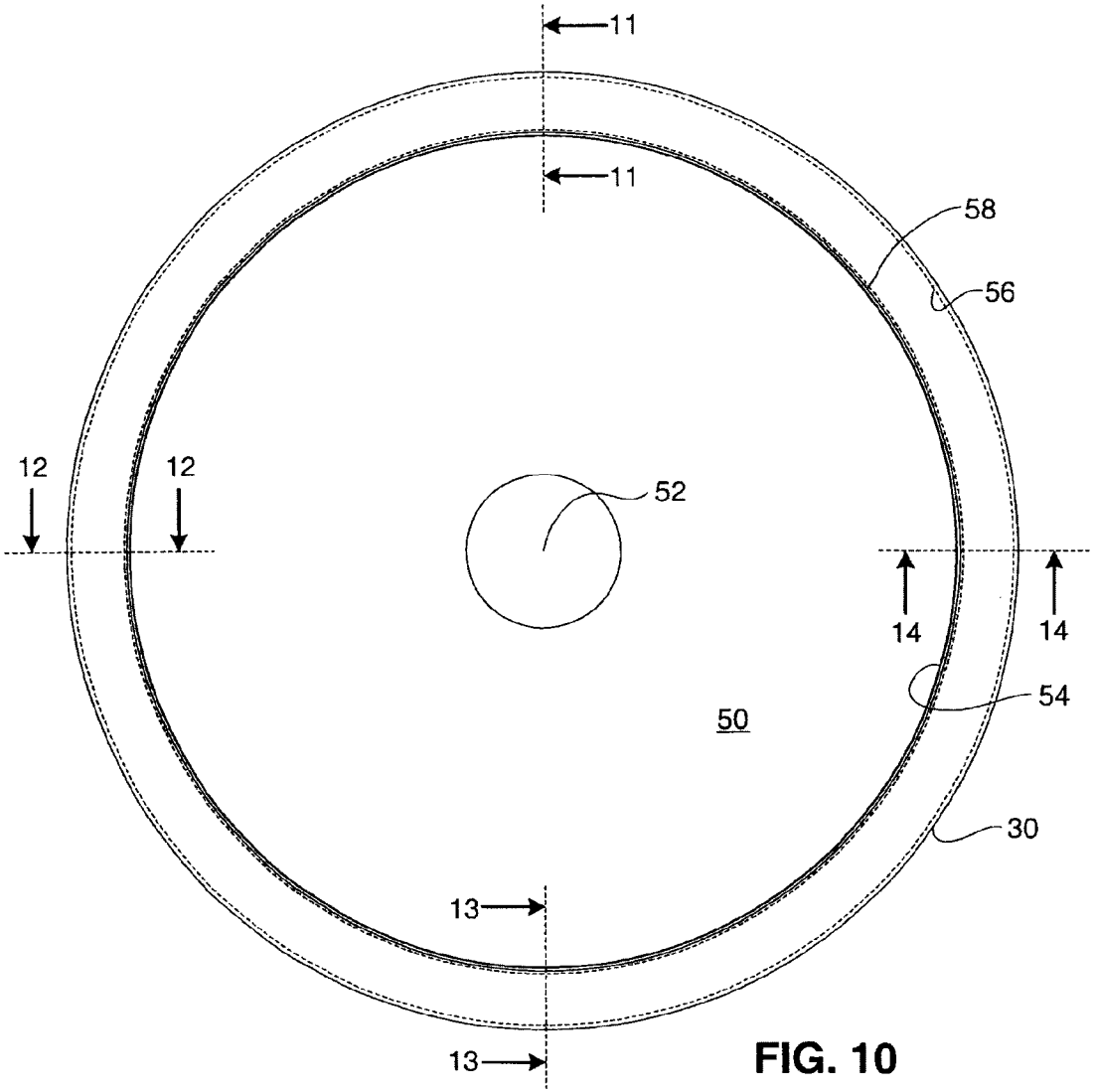
FIG. 10 is a diagrammatic view of a circular loop of a simplified representation of the exemplary untwisted cable of FIG. 5 on an exemplary spool device.

FIG. 10 is a diagrammatic view of a circular loop of a simplified representation of the untwisted composite cable 30 of FIG. 5 (showing a limited number of rods) on an exemplary spool device 50. Actually, since each coil of the untwisted composite cable 30 will be wound helically on the spool device, the coil will not have a completely circular path but a split ring path with the two ends shift from side to side by about the diameter of the cable. However, for purposes of presentation, this view is generally accurate. The spool device 50 can have an axis 52 through which the spool device 50 can be rotated, and a coil carrying portion 54 upon which the composite cable 30 is wrapped. The dashed line 56 corresponds to a path that a particular, outwardly located composite rod 60*a* of the untwisted composite cable 30 (see FIGS. 11-14) will take in a single coil on the spool device 50, and dashed line 58 corresponds to a path that a particular, inwardly located composite rod 60*b* of the untwisted composite cable 30 will take. As can be appreciated, the circumferential length of line 56 will be longer than the circumferential length of line 58, and thus if a composite cable 30 as shown in FIG. 5 is wrapped around the spindle device 30, the composite rods near the outer part of the composite cable 30, e.g., 60*b*, and the outlying composite rods will be under tension and inwardly lying composite rods, 60*b*, will be under compression. Thus, this reality will make it difficult to coil an elongate cable with parallel composite rods around a spindle device.

Figure 11:
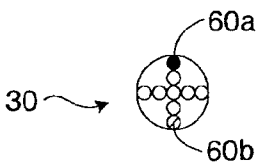
FIG. 11 is a cross-sectional view through the cable on the spool of FIG. 10 through view lines 11-11.

FIG. 11 is a cross-sectional view through the untwisted composite cable 30 on the spool device 50 through view lines 11-11 of FIG. 10, showing an outwardly located composite rod 60*a* and an inwardly located composite rod 60*b*.

Figure 12:
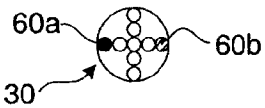
FIG. 12 is a cross-sectional view through the cable on the spool of FIG. 10 through view lines 12-12.

FIG. 12 is a cross-sectional view through the untwisted composite cable 30 on the spool device 50 through view lines 12-12 of FIG. 10, showing an outwardly located composite rod 60*a* and an inwardly located composite rod 60*b*.

Figure 13:
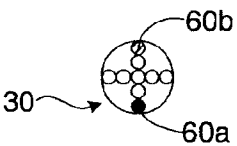
FIG. 13 is a cross-sectional view through the cable on the spool of FIG. 10 through view lines 13-13.

FIG. 13 is a cross-sectional view through the untwisted composite cable 30 on the spool device 50 through view lines 13-13 of FIG. 10, showing an outwardly located composite rod 60*a* and an inwardly located composite rod 60*b*.

Figure 14:
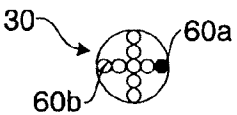
FIG. 14 is a cross-sectional view through the cable on the spool of FIG. 10 through view lines 14-14.

FIG. 14 is a cross-sectional view through the untwisted composite cable 30 on the spool device 50 through view lines 14-14 of FIG. 10, showing an outwardly located composite rod 60*a* and an inwardly located composite rod 60*b*. As can be seen with reference to FIGS. 11-14, the outwardly located composite rod 60*a* follows path 56 and inwardly located composite rod 60*b* follows path 58, with outer path 56 being longer than inner path 58. Thus, with an untwisted composite cable 30 on a spool device 50, there would be tension on the composite rods lying on the outer side of the composite cable 30 (including but not limited to composite cable 60*a*) and compression on the composite rods lying on the inner side of the composite cable 30 (including but not limited to composite cable 60*b*). With long lengths of cable, this would obviously create problems with the efficient winding and unwinding of cables on the spool device 50 and would prevent the selection of a spool device 50 having too small of a diameter.

Figure 15:
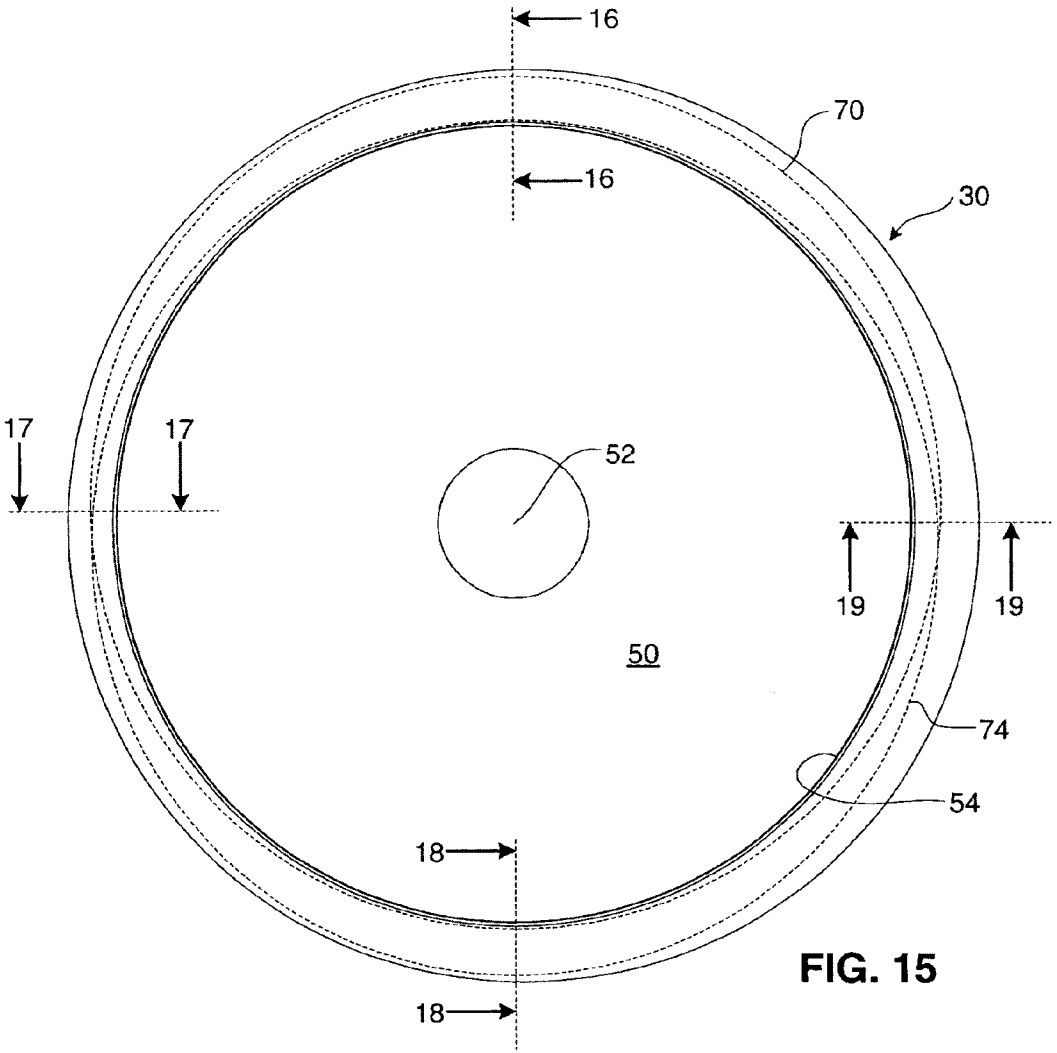
FIG. 15 is a diagrammatic view of a circular loop of a simplified representation of the cable of FIG. 5 that has been twisted on a spool device.

FIG. 15 is a diagrammatic view of a circular loop of a simplified representation of the composite cable 30 of FIG. 5 (showing a limited number of rods) that has been twisted along its longitudinal axis onto the spool device 50 with an axis 52 and the coil carrying portion 54 upon which the composite cable 30 is wrapped. Dashed line 70 generally shows the path of a particular composite rod, such as rod 72*a*, will take as it is wrapped around the spool device 50. Likewise, dashed line 74 generally shows the path of a particular composite rod, such as rod 72*b*, will take as it is wrapped around the spool device 50. The path lengths of 70 and 74 will be the same, and unlike the case of an untwisting parallel composite rod cable as shown in FIGS. 11-14, any given composite rod, such as composite rods 72*a* and 72*b* located on opposite sides of the composite cable will have the same length, and thus, coiling of the composite cable on the spool device 50 will not create uneven tension and compression on the twisted composite cable 30 on the spool device 50. FIGS. 16-19 are cross-sectional views through the composite cable on the spool through view lines 16-16, 17-17, 18-18 and 19-19, and shows the relative location of two selected composite rods 70*a* and 70*b*, which composite rods are located 180° apart from each other in the composite cable 30, has been twisted a total of 360° along its longitudinal axis as it completes one entire loop around the spool device 50.

Figure 16:
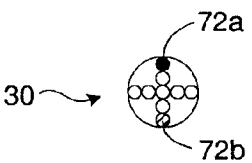
FIG. 16 is a cross-sectional view through the cable on the spool of FIG. 15 through view lines 16-16.

Starting from the cross-sectional view of FIG. 16, composite rod 72*a* will be located along an outermost position on the composite cable furthest away from the coil carrying portion 54 of the spool device 50 and composite rod 72*b* will be located along an innermost position on the composite cable closest to the coil carrying portion 54 of the spool device 50.

Figure 17:
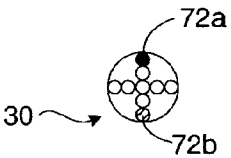
FIG. 17 is a cross-sectional view through the cable on the spool of FIG. 15 through view lines 17-17.

At the cross-sectional view of FIG. 17, both composite rods 72*a* and 72*b* will be located along an intermediate position on the composite cable. This change in relative positions of the composite rods in the composite cable is accomplished by twisting the entire composite cable 30 by about 90° clockwise as the composite cable 30 is wound about a quarter turn (90°) on the spool device 50 from its position shown in FIG. 16 to its position shown in FIG. 17.

Figure 18:
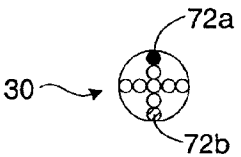
FIG. 18 is a cross-sectional view through the cable on the spool of FIG. 15 through view lines 18-18.

At the cross-sectional view of FIG. 18, composite rod 72*a* will be located along an innermost position on the composite cable closest to the coil carrying portion 54 of the spool device 50 and composite rod 72*b* will be located along an innermost position on the composite cable farthest away from the coil carrying portion 54 of the spool device 50. The change in relative positions of the composite rods in the composite cable is accomplished by twisting the entire composite cable 30 by about 180 degrees clockwise as the composite cable 30 is wound about a half turn (180 degrees) on the spool device 50 from its position shown in FIG. 16 to its position shown in FIG. 18.

Figure 19:
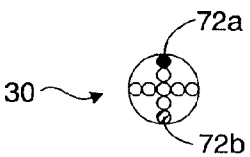
FIG. 19 is a cross-sectional view through the cable on the spool of FIG. 15 through view lines 19-19.

At the cross-sectional view of FIG. 19, both composite rods 72*a* and 72*b* will be located along an intermediate position on the composite cable. This change in relative positions of the composite rods in the composite cable is accomplished by twisting the entire composite cable 30 by about 270 degrees clockwise as the composite cable 30 is wound about a three quarters of a turn (270 degrees) on the spool device 50 from its position shown in FIG. 16 to its position shown in FIG. 19. At the point that the cable has been returned to its starting position at the top of the spool device 50, the cable has twisted 360 degrees.

Figure 20:
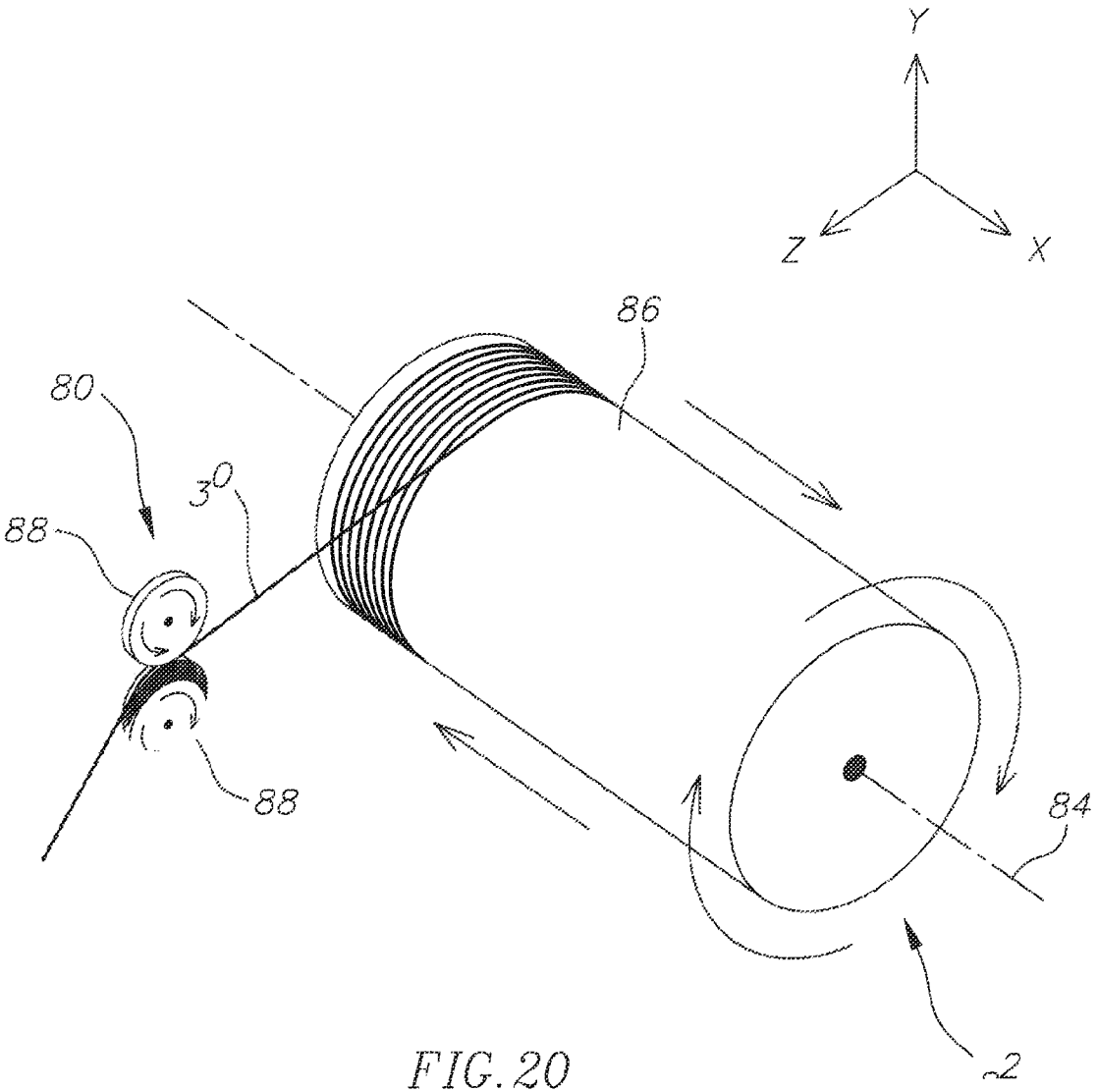
FIG. 20 is a diagrammatic view of an exemplary twisting and winding device for a cable with parallel composite rods, or metal wires, or plastic fibers on a spool.

FIG. 20 is a diagrammatic view of an exemplary winding and unwinding device 80 for twisting a composite cable 30 with parallel composite rod and laying the twisted composite cable 30 onto a spool device 82 with an axis 84 and a cable carrying surface 86. The exemplary winding and unwinding device 80 comprises rollers 88 which ride on the outer surface of the composite cable 30 and apply sufficient pressure to allow the winding and unwinding device 80 to twist the composite cable to change the orientation of its individual composite rods from their parallel configuration to a configuration wherein the bundle of composite rods are twisted in order to reduce tension and compression on the individual composite rods when the composite cable is coiled on the spool device 82. The rollers 88 can be driven and/or braked to control the tension on the composite cable 30 as it twists the composite cable and deposits it on the spool device 82. The twisting of the composite cable 30 will take place along its longitudinal axis. For the purpose of understanding the function of the rollers 88, it is useful to define a 3-D reference frame with orthogonal axes x, y, and z. Assuming that the spool device 82 has an axis 84 oriented along the x axis, the untwisted composite cable 30 is fed through the exemplary winding and unwinding device 80 at an angle (e.g. about 90°, such as along an axis parallel to the z axis) relative to the x axis and passing through the longitudinal axis of the composite cable 30. Other angles can be used instead. As the composite cable is taken up on the spool device 82, the rollers 88 will translate as a unit generally along an x axis to deploy the now twisted composite cable 30 onto the cable carrying surface 86 of the spool device 82. The mechanisms to provide for the translational motion and the twisting motion are not shown. Once one layer of the twisted composite cable 30 has been deposited, the rollers 88 will, on return in an opposite direction (e.g., left to right or right to left), deposit another layer of coiled composite cable 30 onto the previously coiled layer and start over. The exemplary winding and unwinding device 80 can likewise be used for twisting a cable 30 formed from parallel metal wires or plastic fibers or other known materials and combinations thereof.

Figure 21:
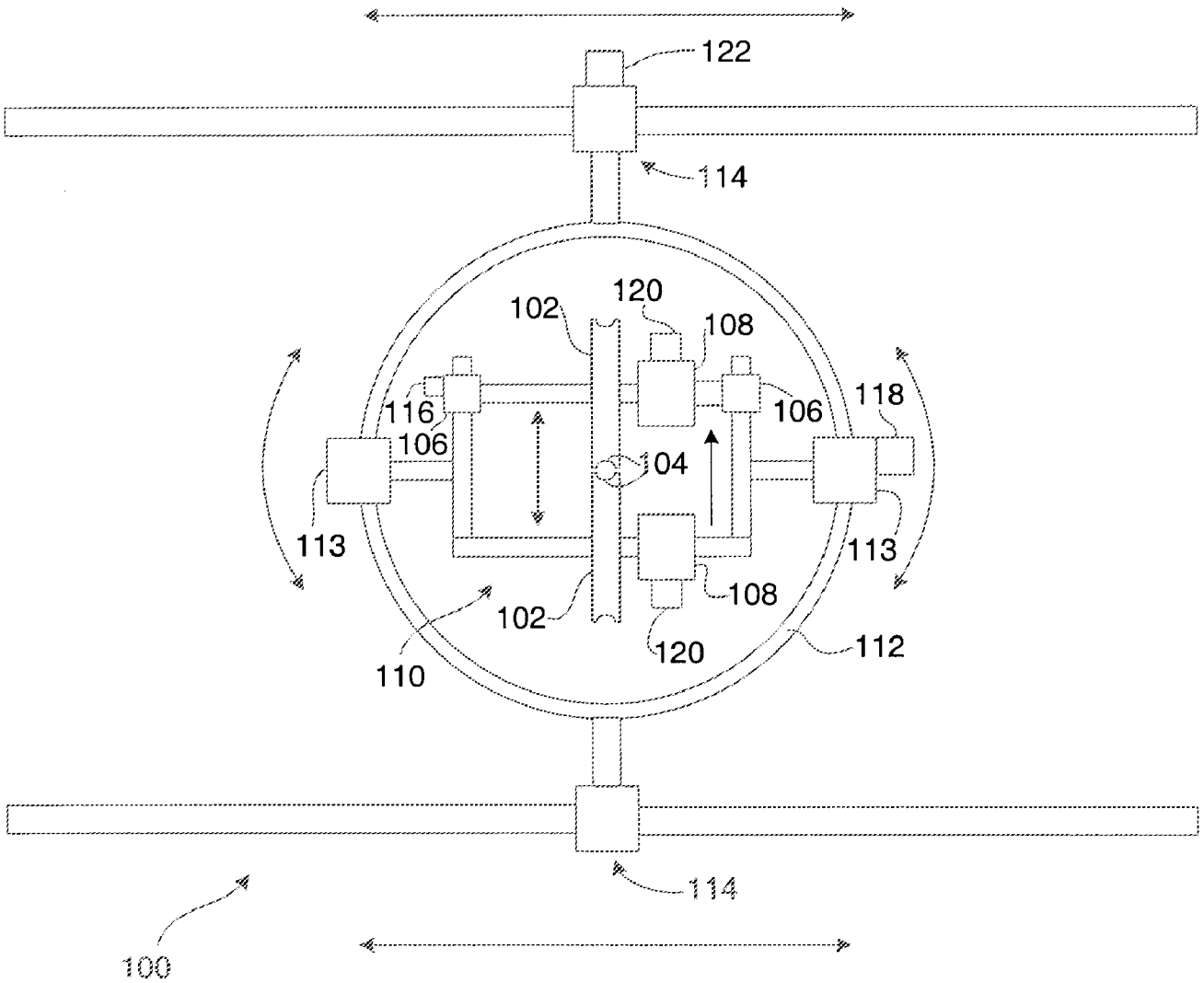
FIG. 21 is a diagrammatic view of another twisting device.

FIG. 21 is a diagrammatic view of another winding and unwinding device 100. It has rollers 102 which will ride on a composite cable (not shown) passing between its two rolling surfaces 104. The rollers 102 can include tension adjusting means 106 to control the tension applied to the composite cable. Turning and/or braking mechanisms 108 will apply a turning and/or braking force to the rollers 102. The rollers 102, tension adjusting means 106, and turning and/or braking mechanism 108 can comprise a carriage 110 that is rotatable as a unit relative to a longitudinal axis of a composite cable passing through the rollers 102 to apply a twist to the cable. The carriage 110 will ride on and be rotated relative to a ring 112 by a rotation mechanism 113 to provide the desired twisting of the composite cable. A lateral slide mechanism 114 is also preferably provided for side-to-side movement of the ring 112 and its rotating carriage 110 to coil twisted composite cable onto a spool device (not shown). Various control mechanisms can be provided to control the movement and operation of the winding and unwinding device 100. For example, a compression control mechanism 116 that controls the degrees of tension applied by the tension adjusting means 106 to the rollers 102 which ride on the composite rod is preferably provided. A rotation control 118 can be provided to control the rotation mechanism 113 and twisting of the composite cable. Turning/braking controls 120 can be provided to control the turning and/or braking mechanisms 108, and a transverse control 122 can be provided to control the lateral slide mechanism 114. For example, the rotation control 118 can control the rotation mechanism to twist the composite cable around its lateral axis about one degree for every degree that the composite cable is coiled around the spool device. The rotation mechanism 113 can also put a twist (e.g., a clockwise twist) on a composite cable for a certain arc distance as the composite cable is coiled around the spool device, and then place an opposite twist (e.g., a counterclockwise twist) on the composite cable for another arc distance. As a non-limiting example, the composite cable can be alternately twisted clockwise by about 180 degrees for about half a turn and then counterclockwise by about 180 degrees for half a turn about as it is coiled around the spool device. The control mechanisms 116, 118, 120, and 122 are diagrammatically shown as separate devices, but if desired they can be combined and/or placed distant from the mechanism(s) they will control.

In the use of the device and method, the composite cable will be twisted as it is coiled onto the spool device, and is untwisted the opposite direction as it is uncoiled from the spool device and is deployed for use, which restores the individual composite rods making up the composite cable to their state where the individual composite rods are generally parallel to each other. It is possible to forego with use of a winding and unwinding device when the composite cable is unwound from the spool device since the cable may naturally tend to revert to a state where the composite rods making up the composite cable return to their parallel, unspiraled and untwisted. In such case, it may or may not be helpful to control the rate at which the composite cable is deployed from the spool device, e.g., by using a drive/braking device on the spool device to control the tension on the composite cable. As noted above, the device and method can be used with elongate strength members that are formed from any material and not just composite rods.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A method for handling an elongate strength member comprising:

taking an elongate strength member that comprises a plurality of elongate composite rods that are bundled together to prevent the rods from separating from each other and bowing out with the composite rods in a generally parallel and untwisted and un-spiraled arrangement when the elongate strength member is extended along a generally straight path, wherein the composite rods are longitudinally and rotatably moveable relative to each other;

twisting the elongate strength member relative to a longitudinal dimension of the elongate strength member; and curving the path of the elongate composite strength member.

2. The method of claim 1, wherein the path of the elongate composite strength member is curved into a series of curves.

3. The method of claim 1, wherein the elongate composite strength member is coiled into a series of generally circular loops.

4. The method of claim 1, wherein the elongate composite strength member is coiled into a series of generally circular coils around a spool device.

5. The method of claim 4, wherein the elongate strength member is alternately twisted clockwise for a distance and then counterclockwise for a distance as the elongate strength member is coiled around the spool device.

6. The method of claim 5, wherein the elongate strength member is twisted about one degree along its longitudinal dimension for about every one degree that the path of the elongate strength member is coiled around the spool device.

7. The method of claim 4, wherein the twisting is accomplished by using a payout device that applies a twisting force to the elongate strength member as the elongate strength member is coiled around the spool device.

8. The method of claim 7, wherein tension is maintained in the elongate strength member as the elongate strength member is coiled around the spool device.

9. The method of claim 7, wherein the payout device applies a compression force to the elongate strength member as the twisting force is applied to cause the elongate strength member to twist and at least some of the elongate composite rods that are arranged in the elongate strength member to twist and spiral relative to a longitudinal direction of the elongate strength member.

10. The method of claim 4, wherein in coils of the elongate strength member on the spool device, the elongate composite rods in a given arc section of the coiled elongate strength member will have generally the same length.

11. The method of claim 10, wherein the individual elongate composite rods of the given arc section will have generally equal compression and/or tension force.

12. The method of claim 4, further comprising withdrawing the elongate composite strength member from the spool device by unwinding the elongate composite strength member from the spool device to cause the twisted elongate strength member to return to a generally untwisted orientation wherein the composite rods will be in a generally parallel and untwisted and un-spiraled arrangement when the elongate strength member is extended along a generally straight path.

13. The method of claim 1, wherein the elongate strength member is twisted about one degree along its longitudinal dimension for about every one degree that the path of the elongate strength member curves.

14. The method of claim 1, wherein the elongate strength member is alternately twisted clockwise and then counterclockwise as its path curves.

15. A method for coiling an elongate strength member that comprises a plurality of elongate composite rods that are bundled together with the composite rods in a generally parallel and untwisted and un-spiraled arrangement when the elongate strength member is extended along a generally straight path, the method comprising taking an elongate strength member that comprises a plurality of elongate composite rods that are bundled together with the composite rods in a generally parallel and untwisted and un-spiraled arrangement when the elongate strength member is extended along a generally straight path wherein the composite rods are longitudinally and rotatably moveable relative to each other;

twisting the elongate strength member; and bending the elongate strength member into a coil.

16. The method of claim 15, wherein the elongate composite strength member is coiled into a series of generally circular coils around a spool device.

17. The method of claim 16, wherein the elongate strength member is twisted about one degree along a longitudinal dimension for about every one degree that the elongate strength member is coiled around the spool device.

18. The method of claim 16, wherein the elongate strength member is alternately twisted clockwise for a distance and then counterclockwise for a distance as the elongate strength member is coiled around the spool device.

19. The method of claim 16, wherein the elongate strength member is twisted about one degree along its longitudinal dimension for about every one degree that the path of the elongate strength member is coiled around the spool device.

20. The method of claim 16, wherein the twisting is accomplished by using a payout device that applies a twisting force to the elongate strength member as the elongate strength member is coiled around the spool device.

21. The method of claim 20, wherein tension is maintained in the elongate strength member as the elongate strength member is coiled around the spool device.

22. The method of claim 15, wherein the elongate strength member is alternately twisted clockwise and then counterclockwise as the elongate strength member is coiled.

23. The method of claim 15, wherein the payout device applies a compression force to an outside surface of areas of the elongate strength member as the twisting force is applied to cause the elongate strength member to twist and at least some of the elongate composite rods that are arranged in the elongate strength member to twist and spiral relative to a longitudinal direction of the elongate strength member.

24. The method of claim 16, further comprising withdrawing the elongate composite strength member from the spool device by unwinding the elongate composite strength member from the spool device to cause the twisted elongate strength member to return to a generally untwisted orientation wherein the composites rods will be in a generally parallel and untwisted and un-spiraled arrangement when the elongate strength member is extended along a generally straight path.

25. The method of claim 15, wherein the plurality of elongate composite rods are bundled together to prevent the rods from separating from each other and bowing out.

* * * * *